US010107037B2

(12) United States Patent
Gajji et al.

(10) Patent No.: US 10,107,037 B2
(45) Date of Patent: Oct. 23, 2018

(54) ROLL REDUCTION SYSTEM FOR ROTARY STEERABLE SYSTEM

(71) Applicant: Halliburton Energy Services, Inc., Houston, TX (US)

(72) Inventors: Bhargav Gajji, Pune (IN); Rahul Ramchandra Gaikwad, Pune (IN); Puneet Agarwal, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 267 days.

(21) Appl. No.: 14/766,927

(22) PCT Filed: Mar. 5, 2013

(86) PCT No.: PCT/US2013/029194
§ 371 (c)(1),
(2) Date: Aug. 10, 2015

(87) PCT Pub. No.: WO2014/137330
PCT Pub. Date: Sep. 12, 2014

(65) Prior Publication Data

US 2015/0368973 A1 Dec. 24, 2015

(51) Int. Cl.

| | |
|---|---|
| ***E21B 17/10*** | (2006.01) |
| ***E21B 4/00*** | (2006.01) |
| ***E21B 7/06*** | (2006.01) |

(52) U.S. Cl.
CPC ..... *E21B 4/006* (2013.01); *E21B 7/062* (2013.01); *E21B 7/068* (2013.01); *E21B 17/1078* (2013.01)

(58) Field of Classification Search
CPC . E21B 3/035; E21B 7/06; E21B 7/067; E21B 17/04; E21B 17/05
USPC ..... 475/164
See application file for complete search history.

(56) References Cited

U.S. PATENT DOCUMENTS

| | | | |
|---|---|---|---|
| 5,685,379 | A | 11/1997 | Barr et al. |
| 5,803,185 | A | 9/1998 | Barr et al. |
| 5,845,721 | A | 12/1998 | Southard |
| 5,875,859 | A | 3/1999 | Ikeda et al. |
| 6,092,610 | A | 7/2000 | Kosmala et al. |

(Continued)

FOREIGN PATENT DOCUMENTS

| | | |
|---|---|---|
| CN | 1965143 | 5/2007 |
| WO | 9630616 | 10/1996 |
| WO | 9836149 | 8/1998 |

OTHER PUBLICATIONS

PCT International Preliminary Report on Patentability, PCT/US2013/029194, dated Sep. 17, 2015, 12 pages.

(Continued)

*Primary Examiner* — Cathleen R Hutchins
*Assistant Examiner* — Brandon M Duck
(74) *Attorney, Agent, or Firm* — Alan Bryson; Parker Justiss, P.C.

(57) ABSTRACT

Roll reduction system for rotary steerable system. A well drilling system includes a tubular housing that attaches inline in a drill string and a bit drive shaft supported to rotate in the housing by a roll reduction system. The roll reduction system includes a first gear carried by the housing to rotate relative to the housing and coupled to rotate with the bit drive shaft, and a second gear carried by the housing to rotate relative to the housing and coupled to the first gear to rotate in an opposite direction to the first gear.

17 Claims, 3 Drawing Sheets

(56) References Cited

U.S. PATENT DOCUMENTS

| | | | | |
|---|---|---|---|---|
| 6,334,486 | B1 | 1/2002 | Carmody et al. | |
| 6,378,626 | B1 | 4/2002 | Wallace | |
| 6,629,570 | B1 | 10/2003 | Head | |
| 6,966,391 | B2 | 11/2005 | Tang | |
| 7,188,685 | B2 | 3/2007 | Downton et al. | |
| 7,464,750 | B2 | 12/2008 | Schapel et al. | |
| 7,467,673 | B2 | 12/2008 | Earles et al. | |
| 7,610,970 | B2 | 11/2009 | Sihler et al. | |
| 8,016,051 | B2 | 9/2011 | Southard | |
| 9,303,457 | B2 * | 4/2016 | Pabon | E21B 7/062 |
| 2004/0256162 | A1 | 12/2004 | Helms et al. | |
| 2006/0266555 | A1 * | 11/2006 | Chen | E21B 7/067 175/61 |
| 2008/0217062 | A1 * | 9/2008 | Southard | E21B 4/006 175/57 |
| 2012/0160563 | A1 | 6/2012 | Clark et al. | |
| 2015/0075871 | A1 | 3/2015 | Strittmatter | |
| 2015/0083496 | A1 | 3/2015 | Winslow | |

OTHER PUBLICATIONS

Office Action issued in Chinese Application No. 201380071301.7, dated Apr. 29, 2016.

PCT International Search Report and Written Opinion of the International Searching Authority, PCT/US2013/029194, dated Nov. 15, 2013, 16 pages.

* cited by examiner

ROLL REDUCTION SYSTEM FOR ROTARY STEERABLE SYSTEM

CROSS-REFERENCE TO RELATED APPLICATIONS

This application is a 371 U.S. National Phase Application of and claims the benefit of priority to International Application Serial No. PCT/US2013/029194, filed Mar. 5, 2013, the contents of which are hereby incorporated by reference.

TECHNICAL FIELD

This disclosure relates to a rotary steerable well drilling system to drill deviated wellbores.

BACKGROUND

A rotary steerable system can be implemented in directional drilling to gradually steer a drill bit attached to a drill string in a desired direction. In directional and horizontal drilling, real-time knowledge of angular orientation of a fixed reference point (called "tool face") on a circumference of the drill string in relation to a reference point on the wellbore can be important. In a rotary steerable system, for example, knowledge of the tool face can be used to actuate the system in a particular angular location. The reference point can be, for example, magnetic north in a vertical wellbore or the high side of the wellbore in an inclined wellbore. Thus, guiding a drill string using a rotary steerable system can require that the tool face be fixed (i.e., stationary).

Tool face can be measured in terms of magnetic tool face (MTF) or gravity tool face (GTF) or both. Tool face can be determined using GTF by measuring components of gravity in three Cartesian coordinate directions (X, Y and Z directions), which can be converted into inclination. But, the drilling conditions can cause the geo-stationary reference point to which the accelerometers are mounted to become non-stationary, which, in turn, can negatively affect tool face determination. For example, vibrations generated during rotary drilling using rotary steerable systems can distort acceleration due to gravity. The distortion can make the measurement of instantaneous values of acceleration due to gravity in the X, Y and Z directions difficult. MTF uses the earth's magnetic field to obtain the tool face with reference to true magnetic north. When rotary systems drill at speeds exceeding 300 rpm and where measurement is needed every millisecond, measuring the magnetic fields with sufficient accuracy can be burdensome to downhole computer and microprocessor systems. In some situations, the MTF may also need to be converted to GTF to get inclinations, which can require solving complex equations. Doing so can also be burdensome on the downhole computer and microprocessor systems.

DESCRIPTION OF DRAWINGS

Like reference symbols in the various drawings indicate like elements.

DETAILED DESCRIPTION

This disclosure describes a roll reduction system for rotary steerable well drilling systems, which can include a housing (for example, a stationary housing) balanced over a rotating bit drive shaft using radial and thrust bearings. The housing can serve as the geo-stationary reference point on which sensors (for example, accelerometers) and electronics can be mounted. Bearing friction between the stationary housing and the bit drive shaft can result in frictional torque, which can be transferred to the housing causing the housing to roll. The roll reduction system described here is affixed to the housing such that rotational torque of the bit drive shaft is transferred to the housing in both clockwise and counter-clockwise directions. In particular, the roll reduction system is affixed to the housing such that one bearing transfers clockwise torque and another bearing transfers counter-clockwise torque simultaneously to the housing, resulting in either no roll or reduction of roll to below an acceptable threshold roll. As described below, the roll reduction system can be affixed to equal numbers of bearing rotating in opposing directions, i.e., clockwise and counter-clockwise, to transfer equal and opposite frictional torque to the housing. Frictional torque in the bearings will be equal if the bearings experience similar operating conditions such as relative speeds with respect to the bit drive shaft, weight on bit (WOB), and torque.

Implementations of the roll reduction system described here can provide one or more of the following advantages. The roll reduction system can isolate the rotary steerable systems from vibrations, for example, the bottom hole assembly (BHA) vibrations, and consequently render the reference point on the drill string substantially geo-stationary. The stationary reference point can facilitate on-the-fly measurements of inclination and azimuth to determine tool face. Other mechanisms implemented to resist the roll include spring loaded blades which can grab the formation in the wellbore. But, such a spring-loaded mechanism may not perform as expected in certain formations that are either too soft or too hard, or in long horizontal laterals. Unlike such spring loaded mechanisms, the roll reduction system described need not grab the formation in the wellbore. Consequently, the likelihood of failure of the roll reduction system in harsh drilling conditions can be decreased. Because power to the roll reduction system can be obtained from the bit drive shaft, no additional power source is needed to reduce roll in the housing.

Figure 1:
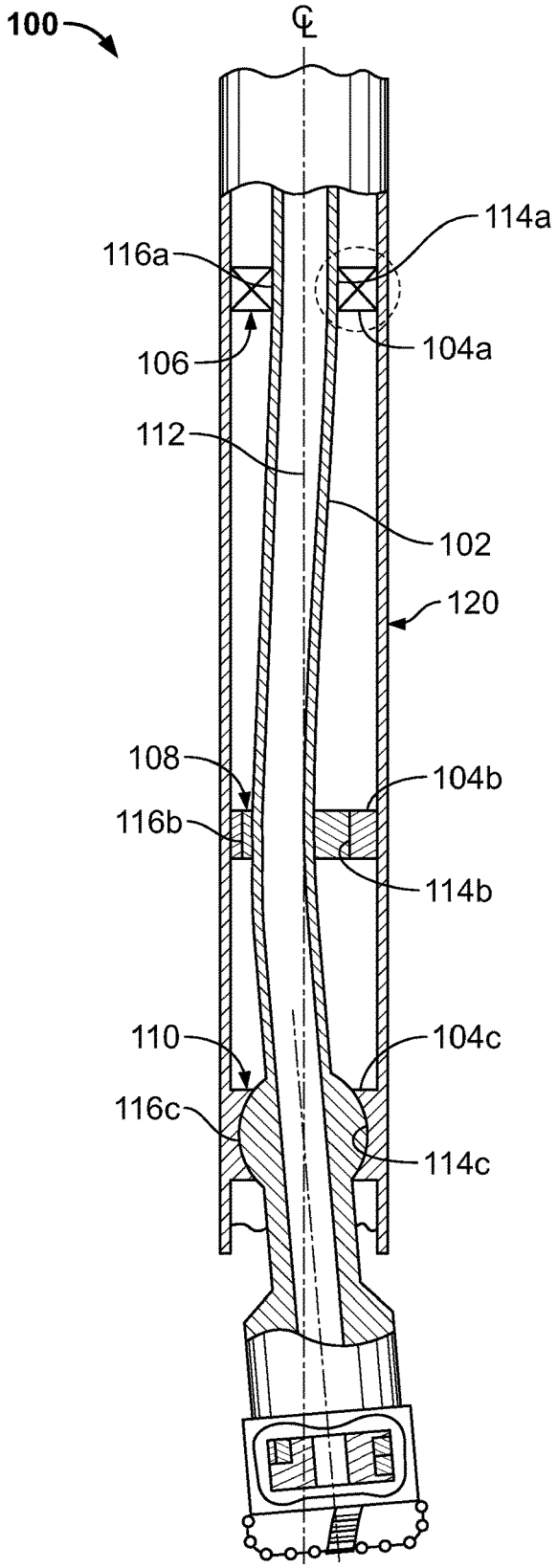
FIG. 1 is a cross-sectional view of an example rotary steerable well drilling system.

FIG. 1 is a cross-sectional view of a well drilling system 100 that includes a rotary steerable system. The rotary steerable system 100 includes a bit drive shaft 102 supported to rotate in a tubular housing 120 by a roll reduction system (for example, one or more of roll reduction system 104*a*, roll reduction system 104*b* or roll reduction system 104*c*). The housing 120 can attach inline in a drill string. The bit drive shaft 102 includes a continuous, hollow, rotating shaft within the housing 120. To do so, the housing can be threaded on one end, which can thread to a preceding joint. The housing can have the same outer diameter as a remainder of the drill string. In general, the roll reduction system can be affixed at one or more locations on the bit drive shaft 102.

In some implementations, the well drilling system 100 can include only one roll reduction system, for example, the roll reduction system 104*b*. The sole roll reduction system can be affixed to any portion of the drill string, for example, either to or near a cantilever bearing 106 or to or near an eccentric cam unit 108 or to or near a spherical bearing 110. For example, the eccentric cam unit 108 can be between an outer surface of the bit drive shaft 102 and an inner surface of the housing 120. Alternatively, the roll reduction system 104*b* can be affixed either uphole of the eccentric cam unit 108 or on the eccentric cam unit 108. In some implementations, the shaft 102 can be supported at multiple positions that are axially spaced apart by multiple roll reduction systems (namely, roll reduction system 104*a*, roll reduction system 104*b*, roll reduction system 104*c*). For example, the roll reduction systems 104*a*, 104*b*, and 104*c* can be affixed to or near the cantilever bearing 106, the eccentric cam unit 108, and the spherical bearing 110, respectively.

To change the direction of drilling, the eccentric cam unit 108 can be used to displace the middle of the bit drive shaft 102 relative to a longitudinal axis 112 of the well drilling system. When the middle of the bit drive shaft 102 is laterally offset relative to the axis 112 and a wellbore is being drilled by the rotating shaft 102, very high contact pressures are experienced between the bearing surfaces (for example, bearing surfaces 114*a*, 114*b*, 114*c*, and bearing surfaces 116*a*, 116*b*, 116*c*). As described below with reference to FIG. 2, one or more of the roll reduction systems 104*a*, 104*b*, and 104*c* can be implemented as a counter-rotation device to simultaneously transfer clockwise and counter-clockwise torque generated by rotating the bit drive shaft 102 to the bearing surfaces, which, in turn, can transfer the clockwise and counter-clockwise torque to the housing 120.

Figure 2:
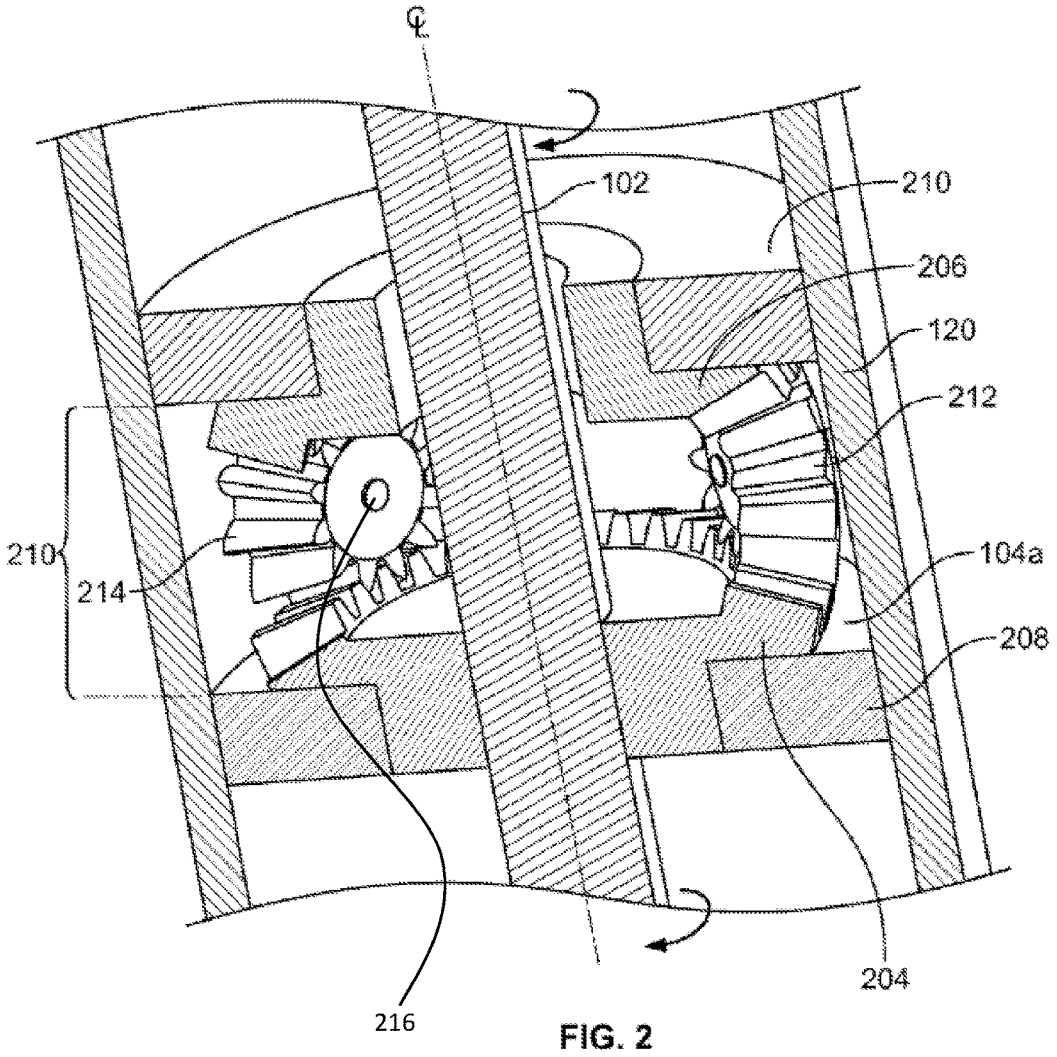
FIG. 2 illustrates a cross-sectional view of an example roll reduction system that includes an example planetary gear system.

FIG. 2 illustrates a cross-sectional view of the roll reduction system 104 that includes a planetary gear system. The roll reduction system 104*a* is a counter-rotation device, which can be affixed to a shaft 102. The roll reduction system 104*a* can include a first gear 204 carried by the housing 120 to rotate relative to the housing 120 and coupled to rotate with the bit drive shaft 102. The roll reduction system 104*a* can also include a second gear 206 carried by the housing 120 to rotate relative to the housing 120, and coupled to the first gear 204 to rotate in an opposite direction to the first gear 204. The second gear 206 is apart from the bit drive shaft 102 to rotate independent of the bit drive shaft 102.

The first gear 204 and the second gear 206 can be a sun gear and a ring gear, respectively, of a planetary gear system 210. The sun gear is configured to couple (for example, in a tight fit, keyed, splined, and/or in another manner) and to rotate with the bit drive shaft 102. The ring gear is coupled to the sun gear to rotate in an opposite direction to the sun gear. Unlike the sun gear, the ring gear is apart from the bit drive shaft 102. The roll reduction system 104*a* can include multiple bevel pinions (for example, a first bevel pinion 212, a second bevel pinion 214) that couple the second gear 206 to the first gear 204. The roll reduction system 104 can include fewer or more bevel pinions, each of which can be mounted on a respective axel 216 that is affixed to the housing 120. Each bevel pinion can be a ring gear of the planetary gear system 210.

The first gear 204 and the second gear 206 are coupled to a first bearing 208 and a second bearing 210, respectively, each of which is affixed relative to the housing 120. In some implementations, the first bearing 208 and the second bearing 210 can be mounted to on surfaces of or outer perimeters of the first gear 204 (i.e., the sun gear) and the second gear 206 (i.e., the ring gear), respectively. Alternatively, the gear-bearing assembly can be integrally formed as a single unit.

In some implementations, the first gear 204 can be a bottom bevel gear to which the bit drive shaft 102 can be directly connected. An outer surface of the first bearing 208 mounted to the bottom bevel gear can be in direct contact with an inner surface of the housing 120. The second gear 206 can be an upper bevel gear which can have a clearance from the bit drive shaft 102. An outer surface of the second bearing 210 mounted to the upper bevel gear can be in direct contact with the inner surface of the housing 120. The bevel pinions can be circumferentially located and equally spaced between the bottom bevel gear and the upper bevel gear to engage both gears. The gear ratios can be maintained such that the upper bevel gear rotates at the same rotational speed as the bottom bevel gear, but in an opposite direction, when the bevel pinions' axes are stationary.

Figure 3:
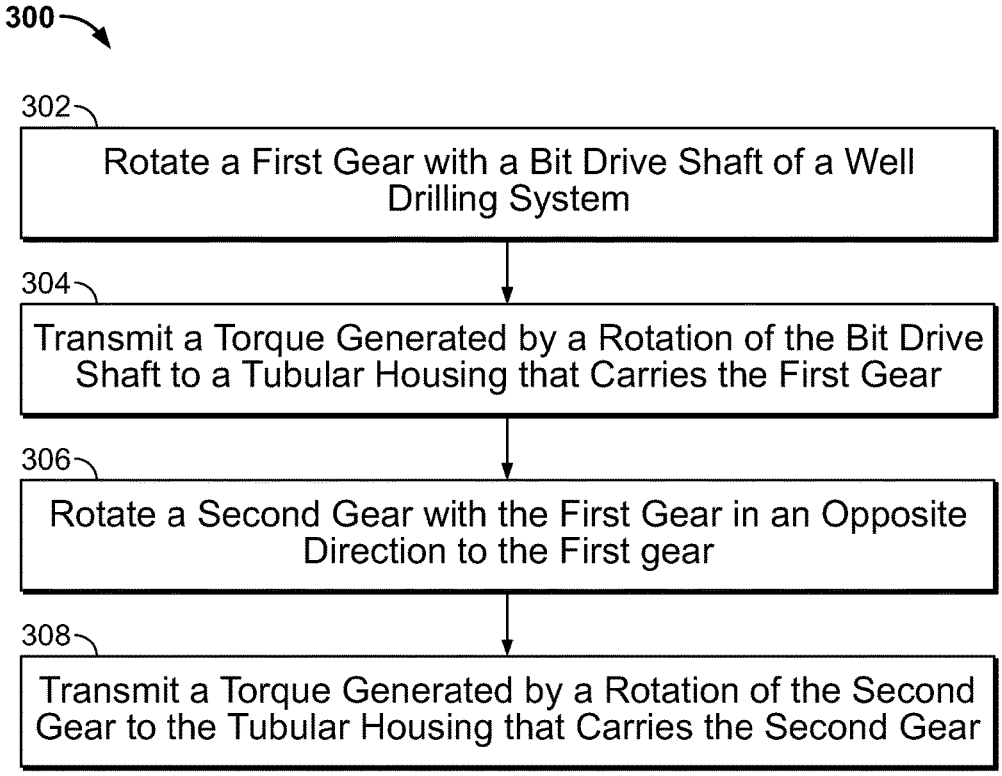
FIG. 3 is a flowchart of an example counter-rotation process for use in a well drilling system.

FIG. 3 is a flowchart of an example counter-rotation process 300 for use in a well drilling system. In operation, at 302, the first gear 204 is rotated with the bit drive shaft 102 of the well drilling system 100. For example, the bit drive shaft 102 is rotated in a clockwise direction. Because the first gear 204 is coupled to the bit drive shaft 102, the first gear 204 also rotates in the clockwise direction. At 304, a torque generated by a rotation of the bit drive shaft 102 is transmitted through the bearing 208 to the housing 120 that carries the first gear 204. For example, the rotation of the bit drive shaft 102 is transmitted to the first bearing 208 that is affixed to the first gear 204 and the housing 120.

At 306, the second gear 206 is rotated with the first gear 204 in an opposite direction to the first gear 204. To do so, the multiple bevel pinions that connect the first gear 204 and the second gear 206 are rotated with the first gear 204. In this manner, the second gear 206 is rotated in a counter-clockwise direction. At 308, a torque generated by a rotation of the second gear 206 is transmitted through the bearing 210 to the housing 120 that carries the second gear 206. For example, the rotation of the second gear 206 is transmitted to the second bearing 210 that is affixed to the second gear 206 and the housing 120. The first bearing 208 and the second bearing 210 can be of the same size and type so that both bearings experience similar operating conditions such as relative speeds with respect to the bit drive shaft, weight on bit (WOB), and torque. Consequently, both bearings experience substantially equal and opposite torques, which are transmitted simultaneously to the housing 120. The resultant torque on the housing 120 will either be zero or below an acceptable threshold, and a roll in the housing 120 will either be minimized or avoided.

A number of embodiments have been described. Nevertheless, it will be understood that various modifications may be made without departing from the spirit and scope of the invention. For example, in some implementations, the well drilling system 100 can include another roll reduction system (for example, roll reduction system 104*b*) that supports the bit drive shaft 102 to rotate in another portion of the housing 120. Similarly to the roll reduction system 104*a*, the roll reduction system 104*b* can include a third gear (not shown) carried by the housing to rotate relative to the housing and coupled to rotate with the bit drive shaft, and a fourth gear carried by the housing to rotate relative to the other housing and coupled to the third gear to rotate in an opposite direction to the third gear.

What is claimed is:

1. A well drilling system comprising: a tubular housing that attaches inline in a drill string; a bit drive shaft supported to rotate in the housing by a roll reduction system, the roll reduction system comprising: a sun gear of a planetary gear system configured to couple with the bit drive shaft to rotate with the bit drive shaft; and a ring gear of the planetary gear system linearly positioned along the drive shaft relative to the sun gear and coupled to the sun gear and coupled to the sun gear via one or more bevel pinions to rotate in an opposite direction to the sun gear and configured to be apart from the bit drive shaft of the well drilling system.

2. The system of claim 1, wherein the well drilling system comprises a rotary drilling system which comprises an eccentric cam unit between an outer surface of the bit drive shaft and an inner surface of the housing.

3. The system of claim 2, wherein the roll reduction system is affixed either uphole of the eccentric cam unit or on the eccentric cam unit.

4. The system of claim 1, wherein the roll reduction system comprises a plurality of bevel pinions that couple the ring gear to the sun gear, wherein each bevel pinion of the plurality of bevel pinions is mounted on a respective axel tat is affixed to the housing.

5. The system of claim 4, further comprising:

another roll reduction system that supports the bit drive shaft to rotate in the other tubular housing, wherein the other roll reduction system comprises:

a third gear carried by the other housing to rotate relative to the other housing and coupled to rotate with the bit drive shaft; and a fourth gear carried by the other housing to rotate relative to the other housing and coupled to the third gear to rotate in an opposite direction to the third gear.

6. The system of claim 1, wherein the sun gear is coupled to a first bearing which is affixed relative to the housing, and the ring gear is coupled to a second bearing which is affixed relative to the housing.

7. The system of claim 6, wherein the first bearing and the second bearing are of the same size.

8. A counter-rotation device for use with a well drilling system, the device comprising: a sun gear of a planetary gear system configured to couple with a bit drive shaft of a well drilling system to rotate with the bit drive shaft; and a ring gear of the planetary gear system linearly positioned along the drive shaft relative to the sun gear via one or more bevel pinions and coupled to the sun gear to rotate in an opposite direction to the sun gear and configured to be apart from the bit drive shaft of the well drilling system.

9. The device of claim 8, wherein the well drilling system is a rotary steerable system.

10. The device of claim 9, wherein the rotary steerable system comprises an eccentric cam unit on an outer surface of the bit drive shaft.

11. The device of claim 8, further comprising:

a tubular housing that attaches inline in a drill string, wherein the sun gear and the ring gear are mounted within the tubular housing;

a first bearing coupled to the sun gear and affixed to the housing; and a second bearing coupled to the ring gear and affixed to the housing.

12. A counter-rotation method for use in a well drilling system, the method comprising: providing a counter rotation device, the counter rotational device including: a sun gear of a planetary gear system configured to couple with a bit drive shaft or a well drilling system to rotate with the bit drive shaft; and a ring gear of the planetary gear system linearly positioned along the drive shaft relative to the sun gear and coupled to the sun gear via one or more bevel pinions to rotate in an opposite direction to the sun gear and configured to be apart from the bit drive shaft of the well drilling system; rotating the sun gear with the bit drive shaft; transmitting a torque generated by a rotation of the bit drive shaft to a tubular housing that carriers the sun gear; rotating the ring gear in the opposite direction relative to the sun gear via the one or more bevel pinions; and transmitting a torque generated by a rotation of the ring gear to the tubular housing that carriers the second ring gear.

13. The method of claim 12, wherein transmitting the torque generated by the rotation of the bit drive shaft to the tubular housing that carrier the sun gear comprises transmitting the torque generated by the rotation of the bit drive shaft to a first bearing affixed to the sun gear and the tubular housing.

14. The method of claim 12, wherein transmitting a torque generated by a rotation of the ring gear to the tubular housing that carriers the ring gear comprises transmitting the rotation of the ring gear to the second bearing affixed to the ring gear and the tubular housing.

15. The method of claim 12, wherein the one or more bevel pinions are a plurality of bevel pinions.

16. The method of claim 12, wherein transmitting the torque generated by the rotation of the bit drive shaft to the tubular housing comprises transmitting the rotation of an eccentric cam unit between an outer surface of the bit drive shaft and an inner surface of the tubular housing.

17. The device of claim 8, wherein a first bearing and a second bearing are mounted to outer perimeters of the sun gear and the ring gear, respectively.

* * * * *